United States Patent [19]

Wallace

[11] 4,045,536

[45] Aug. 30, 1977

[54] METHOD OF CASTING BISMUTH, SILICON AND SILICON ALLOYS

[75] Inventor: John F. Wallace, Shaker Heights, Ohio

[73] Assignee: PPG Industries, Inc., Pittsburgh, Pa.

[21] Appl. No.: 594,184

[22] Filed: July 8, 1975

[51] Int. Cl.[2] ..... B22D 21/00

[52] U.S. Cl. ..... 264/327; 75/134 S; 164/124; 164/126

[58] Field of Search ..... 164/122, 124, 125, 126, 164/128, 348, 338; 249/174; 264/327; 75/134 S, 134 D, 70

[56] References Cited

U.S. PATENT DOCUMENTS

| | | | |
|---|---|---|---|
| 1,251,951 | 1/1918 | Ashdown | 164/126 |
| 1,978,996 | 10/1934 | Gathmann | 164/124 X |
| 2,734,242 | 2/1956 | Marburg | 249/174 |
| 2,821,760 | 2/1958 | Kurzinski | 164/124 X |
| 3,189,440 | 6/1965 | Plust | 75/70 |
| 3,660,081 | 5/1972 | Farrell et al. | 75/134 S X |
| 3,704,745 | 12/1972 | Saunders | 164/126 |

*Primary Examiner*—Robert D. Baldwin
*Attorney, Agent, or Firm*—Richard M. Goldman

[57] ABSTRACT

Disclosed is a method of preparing castings of bismuth, silicon and silicon alloys characterized by solidification expansion by cooling the molten material below its melting point to form a casting of the material within a suitable container. According to the disclosed method, a tapered liquid core with the smaller end downward and the larger end upward and a portion of the top of the casting, i.e., a liquid pool on top of the casting, are maintained in a molten state and in liquid communication with each other until the casting is substantially solidified, for example, by keeping the liquid pool on top molten by insulation or by heat addition or by both insulation and heat addition. Thereafter, the core and the top are allowed to solidify, providing a casting substantially free of defects.

4 Claims, 4 Drawing Figures

FIG. 1
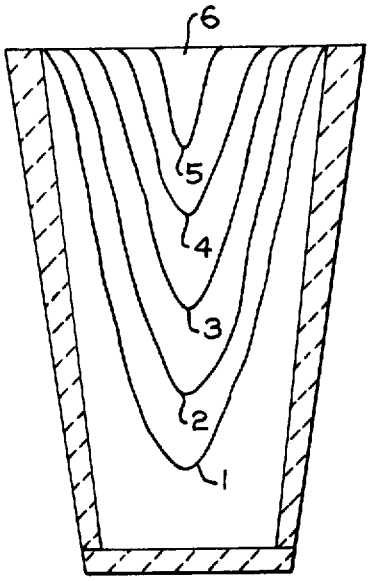
FIG. 2
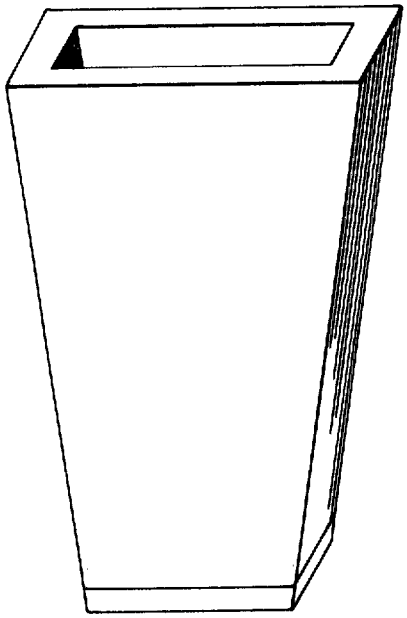
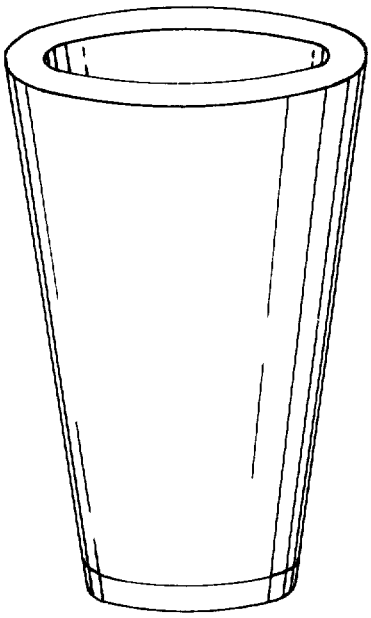
FIG. 3
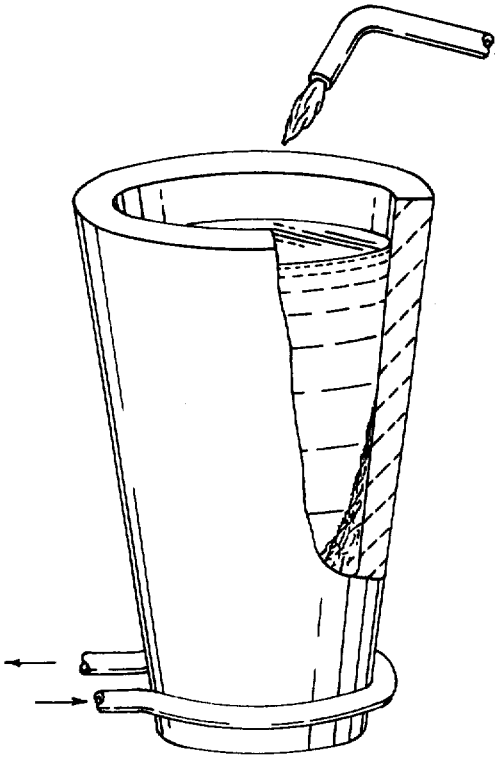
FIG. 4

METHOD OF CASTING BISMUTH, SILICON AND SILICON ALLOYS

DESCRIPTION

Problems are encountered in obtaining a fracture-free, defect-free casting of bismuth, silicon and silicon alloys having solidification expansion. By solidification expansion is meant that the volume of the solid material is greater than the volume of the liquid material at the melting point of the material and within a reasonable range of the melting point of the material, i.e., within about 100 Centigrade degrees of the melting point. The materials characterized by solidification expansion are a unique class of materials. Most metals of commerical and industrial significance have a close packed crystal structure and, therefore, contract upon solidification. However, silicon and high silicon alloys, i.e., silicon alloys containing in excess of 95 atomic percent silicon and in some cases as low as in excess of 92 atomic percent silicon, are characterized by solidification expansion. Commercial grade silicon, i.e., alloys containing 98 plus percent silicon, has a solidification expansion of about 8 percent where the solidification expansion is defined as:

$$\left[\frac{V_{solid} - V_{liquid}}{V_{solid}}\right] \times 100 \text{ melting temp.}$$

Electrolytic grade silicon, i.e., silicon intended for use as a non-consumable electrode in electrolytic processes, such as battery electrodes, fuel cell electrodes, and coated electrodes for electrolytic cells, containing from about 0.1 percent to about 1.5 percent of a dopant, as well as about 0.5 percent or even 1 percent of various impurities, typically has a solidification expansion of on the order of about 5 to 8 percent.

Casting of materials having solidification expansion, such as silicon and alloys thereof, in rigid, vertical ingot molds that do not allow for the solidification expansion which occurs causes cracks, fissures, and fractures throughout the casting. These cracks, fissures, and fractures serve as the site for corrosive attack by electrolytes.

In order to avoid fracturing the ingot, the solidification expansion of the silicon may be offset in various ways. For example, horizontal open molds can be used where the ingot molds are open at the top and are greater in length and width than in height, for example, 20 or 30 inches long by 10 or 12 inches wide by 1 or 2 inches high. Silicon cast in such molds generally has an upward development of the casting whereby the casting appears to have one large single curvature extending from the sides to the center thereof. Alternatively, silicon may cast in expandable molds, that is, molds capable of expanding to take up the solidification expansion of the silicon. Ingots cast in such molds, however, are characterized by bulges, curvatures, and surface irregularity.

Flat-walled castings are particularly desirable in electrolytic applications, for example, to eliminate hot spots on the high areas, i.e., the curves and bulges. These hot spots occur when the bulge or top of the curve, being closer to an electrode of opposite polarity, carries a greater fraction of the current, thereby becoming electrically heated or electrically heating the electrocatalytic coating thereon, as by $I^2R$ resistance heating. Furthermore, the brittleness of the silicon effectively precludes forging to remove the large bulges and curves.

It has now been found that substantially fracture-free castings of bismuth, silicon and silicon alloys having solidification expansion may be obtained by transferring the molten material to an environment below its melting point in a suitable container while maintaining a tapered core with the smaller end downward and the larger end upward and a portion of the top of the casting molten and in liquid communication with each other until the casting is substantially solidified. Then the core, followed by the top, may be permitted to solidify. It is believed that the solidification expansion of the solidifying metal forces molten material up through the tapered core, thereby directing the expansion upwardly. In this way, a casting is obtained which is substantially fracture-free and substantially free of bulges, cracks, fissures, curves, and fractures, and with the sides corresponding in shape to the container walls.

DESCRIPTION OF THE FIGURES

FIG. 1 is a schematic cutaway of a material casting showing lines of liquid/solid interface with increasing time during solidification.

FIG. 2 is a planar walled pyramidal ingot mold useful in the practice of this invention.

FIG. 3 is a circular walled conical ingot mold useful in the practice of this invention.

FIG. 4 is a circular walled ingot mold having means for applying heat at the top of the ingot mold and insulation at the top of the ingot mold and cooling means at the bottom of the ingot mold.

DETAILED DESCRIPTION OF THE INVENTION

Expansion solidification is a property wherein the volume of solid material is greater than the volume of liquid material at the melting point thereof. The percent solidification expansion is defined as:

$$\left[\frac{V_{solid} - V_{liquid}}{V_{solid}}\right] \times 100 \text{ melting temp.}$$

Silicon and silicon alloys containing in excess of 95 percent silicon and occasionally even as low as 92 percent silicon, such as silicon-iron alloys, silicon-cobalt alloys, silicon-nickel alloys, and the like, and bismuth, and are subject to solidification expansion. Electroconductive alloys of silicon containing in excess of about 97 or 98 percent silicon, from about 0.1 to about 1.5 weight percent of the dopant as will be enumerated more fully hereinafter, and up to about 1.5 percent impurities typically have a solidification expansion of from about 5 to about 8 percent.

According to the method of this invention, bismuth silicon and silicon alloys having solidification expansion are cast by cooling the molten material below its melting point in a suitable container while maintaining the tapered core and a portion of the top of the casting molten and in liquid communication with each other, that is, with the tapered internal molten core extending to The molten pool on the top of the casting. The molten core and molten portion of the top of the casting are maintained molten and in liquid communication with each other until the casting is substantially solidified. Thereafter, the core, followed by the top, is allowed to solidify.

The method of this invention is directed to keeping the top surface and tapered core in contact with the top surface molten rather than to a moving molten zone as in zone melting where the molten zone or region travels through the casting, bounded at opposite ends thereof by solid metal. The method of this invention includes keeping the top surface and tapered core molten by directional solidification in order to avoid cracking a material having solidification expansion rather than the directional solidification during pouring of a metal having solidification contraction to keep metal feed channels open while feeding molten metal from a molten metal source, such as is disclosed in U.S. Pat. No. 961,854. The method of this invention is concerned with controlled solidification to allow bismuth, silicon and silicon alloys having solidification expansion to expand upward through the tapered molten core rather than with methods of avoiding "piping" of metals having solidification contraction by controlled solidification, e.g., directional cooling to avoid piping (as disclosed in U.S. Pat. Nos. 807,028; 964,576; 1,711,052; 1,865,041; 3,268,963; and 3,633,656), applying heat to the top of the ingot mold to avoid piping (as disclosed in U.S. Pat. Nos. 216,117; 866,497; 937,163; 1,116,899; 1,310,072; 1,789,883; 1,865,041; and 2,821,760), insulated and heated tops to avoid piping (as disclosed in U.S. Pat. Nos. 1,180,677; 1,181,209; 1,207,054; 1,207,645; 2,402,833; 3,262,165; and 3,766,695), and variation of the heat transfer coefficient through the ingot mold wall to avoid piping (as disclosed in U.S. Pat. No. 1,192,617).

By substantially solidified is meant that solid material is no longer capable of moving readily with the liquid material . According to the literature, substantially solidified material, as the term is intended to be used herein, refers to the state of a material where that material which is still liquid is substantially residual liquid material between the crystals and dendrites of solid material. Substantial solidification, as the term is used herein, may be evidenced by a sharp increase in the shear stress of the melt versus the fraction of solid in the melt or by a sharp increase in the yield stress of the melt versus the fraction of solid in the melt. The exact point at which the melt may be characterized as substantially solidified depends upon the thermal history of the melt and the geometry of the container but is typically always above 60 percent solid and is frequently above 80 percent solid and may even be in excess of 80 percent solid.

The effect of maintaining a tapered molten core within the solidified casting and a molten pool on top of the casting, the tapered molten core and the molten pool being in liquid communication with each other until the casting is substantially solidified, is to allow the solidification expansion of the solidifying material to drive molten material upward through the tapered molten core to the molten pool on the top of the casting. In this way, the solidification expansion of the material is compensated by the upward movement of molten material through the tapered molten core to the molten pool of the top of the casting. In this way, a casting substantially free of bulges, fissures, cracks, and fractures is obtained.

The method of this invention may be carried out by progressively cooling the casting inwardly and upwardly from the bottom and walls of the container to form a tapered molten core with the smaller end downward and the larger end upward as shown in FIG. 1. According to one exemplification of this invention, solid material is formed on the walls and bottom of the ingot mold or container while a hollow molten core is maintained within the casting and a molten pool is maintained on top of the casting. This may be clearly seen in FIG. 1 which is a pictorial representation of a hypothetical, idealized history of the liquid-solid interface in a preferred exemplification of this invention. As there shown, the liquid-solid interface moves gradually inward from the walls and upward from the bottom of the container while a molten core, gradually diminishing in length, is maintained within the casting until the only portion molten is the pool on the top surface of the ingot. Line 1 shows an initial solid material shell on the ingot mold, for example, on the walls and bottom of the mold. Lines 2 to 5 show a liquid-solid interface growing inwardly and upwardly but with the top of the material molten rather than solidified as would be expected by the large mount fo heat radiated from the top. The top is maintained molten by diminishing the effective heat transfer rate from the top of the ingot mold relative to the rate that would normally be expected. Line 6 shows that the top is solidified last, after the core is substantially solidified and the ingot is substantially solidified.

The solid liquid boundary is only macroscopically illustrative of the hypothetical idealized model. The actual boundaries are reported in the literature to be accompanied by the formation of dendrites and the deposition of solidifying material on the dendrites followed by further growth of dendrites.

The method of this invention may be carried out, according to a preferred exemplification, by cooling the bottom and sides of the container or ingot mold at a higher rate than the top. In this way, the effective rate of heat transfer out of the metal, expressed as energy per area per time, i.e., British Thermal Units per square foot per second or kilo-calories per square centimeter per second, is a relative maximum near the bottom of the molten material and a relative minimum near the top of the molten material. According to this exemplification, the effective rate of heat transfer out of the material decreases from the bottom of the molten material to the top of the molten material. Heat may be transferred into the material at the molten pool and out of the material at the molten pool.

One way this may be accomplished is by providing a higher heat transfer coefficient at the bottom of the container than at the top, for example, by providing a thinner bottom and a thicker top of the container, i.e., thinner walls near the bottom of the container and thicker walls near the top of the container for a material of low specific heat and low thermal conductivity or by providing thinner walls near the top of the container and thicker walls near the bottom of the container for a material of high specific heat. Alternatively, the effective rate of heat transfer out of the material may be made to decrease from bottom to top by having a progressively greater distance for the heat to flow out of the molten material at the bottom of the molten material and lower portion of the molten material than at the top of the molten material and higher portions of the molten material, as for example, by tapering the inside walls of the container outward as shown in FIGS. 2 and 3. As there shown, the taper is from about 2° to about 12° and preferably from about 3° to about 8° with tapers of from about 5° to about 7° being effective in a container of uniform wall thickness to provide a higher effective rate of heat transfer in a lower portion of the molten material and a lower effective rate of heat transfer in a higher portion. Preferably, the effective rate of heat transfer out of the metal monotonically decreases from the bottom of the casting upward to the top of the casting, thereby further avoiding fractures and defects.

FIG. 2 shows one exemplification where a pyramidal container has planar walls extending upwardly and outwardly from the central axis. FIG. 3 shows a second exemplification where the container has conical walls extending upwardly and outwardly from the central axis of the container.

According to a still further exemplification of this invention, the walls can increase in thickness toward the top of the container to the bottom of the container and an interior geometric parameter of the container, i.e., the diameter, radius, circumference, or perimeter, can increase from the bottom of the container toward the top of the container, increasing with height.

According to another method of this invention, heat may be removed from the bottom of the container or ingot mold or added at the top thereof or removed from the bottom of the contaner and added at the top of the container. Heat may be removed from a lower portion of the ingot mold or container by a heat sink at the lower end, for example, inserting the lower end of the container in a material of high specific heat such as sand or wet sand, or resting the ingot mold on a water cooled metal plate or other similarly cooled surface. Alternatively or additionally, heat may be added at the top of the contaner as by an electric arc, a flame, or a torch. According to a preferred exemplification on this invention, illustrated in FIG. 4, heat may be added at the top of the container and simultaneously removed at a lower portion of the container whereby to augment the effective rate of heat transfer out of the molten material at a lower portion of the molten material while decreasing the effective rate of heat transfer out of the molten material at the surface of the molten material. This may be carried out for from about 10 minutes to about 1 hour or more, and at least until no more molten material is seen to flow upward through the tapered molten core.

The addition of heat to the top of the molten material and removal of heat from a lower porion of the molten material promotes a directional flow of heat that serves to maintain the tapered core molten and the pool on top of the material molten until the casting is substantially solidified. This heat may be added to the top of the molten material by a torch, as an oxy-acetylene torch, or by an arc, as a constant voltage arc, or the like.

The ingot mold is fabricated from a material that is resistant to the molten material. When the molten material is silicon and the mold may be fabricated of silica, alumina, chromate, zirconia, zircon, carbon, or the like. Preferably, carbon is used because of its high heat conductivity and greater chemical and physical stability during casting.

According to one embodiment of this invention, the mold is fabricated of ¼ inch to 1 inch thick graphite having outwardly tapered walls. The top geometric parameter, i.e., radius, diameter, or thickness, is 1.2 to 2.0 times the bottom geometric parameter, and the taper is from about 1° to about 10°. The thickness of the graphite itself is not critical as long as it is capable of withstanding thermal shock on pouring the molten silicon therein.

Prior to pouring silicon into the mold, the mold is preheated in order to avoid thermal shock of the ingot. The mold is preheated sufficiently to avoid thermal shock, e.g., above 800° C., and frequently to a temperature above about 1100° C. and even about 1150° C. The molten silicon is then poured at a temperature above the melting point, 1407° C., for example, at a pouring temperature of about 1470° C. or even above about 1600° C. While this embodiment has been described with reference to pouring molten silicon into the mold, the silicon may also be melted in the mold. A torch or arc may then be maintained at the top of the mold until the silicon is solidified, i.e., for about 10 minutes to about 1 hour or more, after which the mold may then be cooled and the ingot removed therefrom.

The method of this invention is particularly useful in casting electroconductive silicon for use in fabricating electrolytic anodes as described in U.S. Pat. No. 3,852,175 to Howard H. Hoekje for *Electrodes Having Silicon Base Members* and bipolar electrolytic cell elements as described in U.S. Application Ser. No. 421,706, filed Dec. 4, 1973, by Howard H. Hoekje for *Electrolytic Cell Having Bipolar Anodes.* Such electroconductive silicon has an elctrical conductivity of at least 100 (ohm-centimeters)$^{-1}$ and contains from about 0.1 to about 1.5 weight percent of dopants, and may also contain small amounts of impurities. The dopant may be an electron donor such as nitrogen, phosphorous, arsenic, antimony, or bismuth, or an electron acceptor such as boron, aluminum, or gallium. Most frequently, the dopant is phosphorous or boron, with boron being preferred. The silicon may also contain alloying agents and impurities in concentrations up to about 1.5 weight percent of various metal and metal silicides. Additionally, small amounts of entrained metal oxides, i.e., slag, may be present. After casting, a low overvoltage electrocatalytic material may be applied to the external surface of the silicon castings.

The following examples are illustrative.

EXAMPLE I

A silicon casting was cast in a tapered graphite mold with heating of the top of molten metal, and a casting substantially free of cracks in the major portion thereof was recovered.

An ingot mold was prepared having ½ inch thick graphite walls. The interior dimension of the ingot mold was 6¼ inches by 1¼ inches at the top, 3 inches by 1¼ inches at the bottom, and 28 inches high.

A melt of 18 pounds of commercial silicon containing trace amounts (total under 1 weight percent) of manganese, magnesium, iron, chromium, aluminum, calcium, vanadium, titanium, copper, nickel, and zirconium, and 152 grams of sodium tetraborate was prepared and melted in a graphite crucible. The melt was maintained at a temperature of 1480° C. and poured into the tapered ingot mold which was preheated to a temperature of 1150° C. After pouring, the top of the silicon was heated with a torch for about 12 to 15 minutes while a stream of molten silicon, driven by expansion of the solidifying silicon, flowed upward through the molten tapered core of the metal and dispersed around the top of the casting. After apparently complete solidification of the body of the casting, the top of the mold was allowed to solidify. After 3 hours of cooling by standing in air at room temperature, the casting was removed from the graphite mold and examined. All of the portion of the casting below the level of the mold walls was found to be a smooth casting substantially free of cracks, fissures, fractures, and surface defects.

EXAMPLE II

A silicon casting was cast in a tapered graphite mold with heating of the top of the molten metal and a casting substantially free of cracks in the major portion thereof was formed.

A trapezoidal ingot mold was prepared having ½ inch thick graphite walls. The interior of the ingot mold was 1 5/16 inches by 5½ inches at the bottom, 1½ inches by 6 inches at the top, and 12 inches high. The ingot mold was preheated to 1190° C. By a heating element in an insulated brick furnace while the silicon was melted.

Two crucibles of silicon were prepared. Each crucible contained 3,000 grams of silicon and 55.8 grams of boron as sodium tetraborate. The crucibles containing the silicon were heated to 1520° C. and then maintained at 1520° C. for more than 30 minutes.

The molten silicon was then poured into the preheated graphite ingot mold. This was done by removing the preheated ingot mold from the insulated furnace and pouring molten metal from each of the crucibles into the ingot mold until the ingot mold began to overflow. The ingot mold was then placed back in the insulated furnace and the top of the molten metal was heated with an oxy-acetylene torch. The top was heated until molten metal was no longer flowing up to the top of the casting, a period of about 30 minutes. The ingot mold was then removed from the furnace and allowed to cool in air for about 2 hours.

After 2 hours the ingot was removed from the ingot mold. The surface appeared to be smooth, flat, and free of cracks. An overflow deposit of about 10 percent of the volume of silicon was on the top of the casting, above the level of the ingot mold walls.

While the method of this invention has been described with respect to particular exemplifications and embodiments thereof, the invention is not intended to be so limited except as described in the appended claims.

I claim:

1. In a method of preparing castings of materials having solidification expansion, which materials are chosen from the group consisting of bismuth, silicon and silicon alloys containing in excess of 92 atomic percent silicon, wherein the molten material is cooled to establish a casting thereof in a container, the improvement comprising cooling said material in a rigid, elongated, vertically disposed container having a higher rate of heat transfer our of said container in lower portions thereof then in higher portions thereof while applying heat to the top of said casting as said casting solidifies whereby to maintain a core and a portion of the top of the casting molten and in liquid communication with each other until the casting is substantially solidified.

2. The method of claim 1 comprising cooling the bottom and sides of the container while maintaining a portion of the top of the material molten and in liquid communication with the molten core.

3. The method of claim 2 comprising progressively cooling the casting inwardly and upwardly from the walls and bottom of the container.

4. The method of claim 1 wherein the side walls of the container taper outwardly from a vertical axis of the container.

* * * * *